US008611767B2

(12) United States Patent
Izumiya et al.

(10) Patent No.: US 8,611,767 B2
(45) Date of Patent: Dec. 17, 2013

(54) IMAGE FORMING APPARATUS WITH A PHOTORECEPTOR

(75) Inventors: Kenji Izumiya, Hachioji (JP); Atsushi Takahashi, Akishima (JP); Hiroshi Oyama, Hino (JP); Yumiko Higashi, Hachioji (JP); Katsuyuki Ikuta, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 112 days.

(21) Appl. No.: 13/296,927

(22) Filed: Nov. 15, 2011

(65) Prior Publication Data

US 2012/0128378 A1 May 24, 2012

(30) Foreign Application Priority Data

Nov. 19, 2010 (JP) ..... 2010-258867

(51) Int. Cl.
*G03G 15/00* (2006.01)

(52) U.S. Cl.
USPC ..... 399/26

(58) Field of Classification Search
USPC ..... 399/26, 9, 345, 159, 31, 72
See application file for complete search history.

(56) References Cited

U.S. PATENT DOCUMENTS

| | | | | |
|---|---|---|---|---|
| 2005/0089340 | A1 * | 4/2005 | Yamamoto | 399/49 |
| 2008/0008490 | A1 * | 1/2008 | Sanmonji | 399/71 |
| 2008/0075476 | A1 * | 3/2008 | Nakazato et al. | 399/15 |

FOREIGN PATENT DOCUMENTS

| | | |
|---|---|---|
| JP | 7-55710 | 3/1995 |
| JP | 7-191580 | 7/1995 |
| JP | 2009-199036 | 9/2009 |

* cited by examiner

*Primary Examiner* — Billy J Lactaoen
(74) *Attorney, Agent, or Firm* — Finnegan, Henderson, Farabow, Garrett & Dunner, L.L.P.

(57) ABSTRACT

Disclosed is an image forming apparatus, which makes it possible to reduce the frequency of image defect occurrences to a level as lower as possible by detecting abnormalities generated with age on the photoreceptor member and/or in the cleaning section, so as to suppress an amount of spoiled paper sheets and material. The image forming apparatus includes: a light source that is disposed at a position located between a cleaning section and a charging section, to emit an inspection light, which is to be irradiated onto a photoreceptor member over a main-scanning direction thereof; a tight-contact type image sensor that has a line image sensor to receive the inspection light reflected from a surface of the photoreceptor member; and a control section to determine a status of a surface of the photoreceptor member, based on a result of analyzing the inspection light receive by the line image sensor.

12 Claims, 9 Drawing Sheets

IMAGE FORMING APPARATUS WITH A PHOTORECEPTOR

This application is based on Japanese Patent Application NO. 2010-258867 filed on Nov. 19, 2010, with Japan Patent Office, the entire content of which is hereby incorporated by reference.

BACKGROUND OF THE INVENTION

The present invention relates to an image forming apparatus that forms an image based on image data, and transfers the image onto a paper sheet, so as to conduct a printing operation.

An image forming apparatus forms an image based on image data onto a photoreceptor drum, and transfers the image onto a paper sheet directly or through an intermediate transfer belt. Concretely speaking, when forming the image, the image forming apparatus forms a latent image onto the photoreceptor drum through the exposing process including steps of uniformly charging the photoreceptor drum, and irradiating light, which is emitted from a laser diode or the like, and the intensity of which is modulated on the basis of the image data, onto the photoreceptor drum. Successively, the latent image formed on the photoreceptor drum is developed with toner, fed from a developing section, so as to form a toner image thereon. Still successively, the concerned toner image is directly transferred onto the paper sheet at a transferring section, or the concerned toner image is primarily transferred onto the intermediate transfer belt, and then, the toner image transferred onto the intermediate transfer belt is further transferred onto the paper sheet at a secondary transferring section. After the transferring operation has been completed, a cleaning section removes residual toner remaining on the photoreceptor drum from the circumferential surface thereof, and further, a discharging section discharges the residual electric potential still residing on the circumferential surface of the photoreceptor drum, so as to prepare for the next image forming operation.

In the image forming apparatus as abovementioned, since the printing operation is achieved by transferring the toner image, formed on the photoreceptor drum, onto the paper sheet as its final step, if a certain abnormality, such as a scar or the like, resides on the photoreceptor drum, an abnormal image would be transferred onto the paper sheet, and accordingly, sometimes, it would become difficult to obtain a good printing result.

To cope with such the drawback, for instance, Tokkaihei 7-55710 (Japanese Patent Application Laid-Open Publication) sets forth a defect inspection apparatus that detects a surface defect, such as a scar or the like, generated on the circumferential surface of the photoreceptor drum currently manufactured. The defect inspection apparatus concerned includes: a light source to irradiate a light onto the photoreceptor drum in a direction of the circumferential surface axis thereof, a line sensor that receives a reflected light reflected from the irradiation surface so as to detect the intensity of the reflected light; and a signal processing section to process the signal outputted from the line sensor; so as to make it possible to detect the defect by focusing a bright image section and a dark image section, formed on the circumferential surface of the photoreceptor drum, onto the line sensor.

Further, in order to detect a deterioration of the charging device, Tokkaihei 7-191580 (Japanese Patent Application Laid-Open Publication) sets forth an electro-photographic type recording apparatus that is provided with: a line sensor that is disposed downstream the developing device so as to read a visual image residing on the circumferential surface of the photoreceptor drum located upstream the charging device; a detecting section that processes a signal read by the line sensor so as to detect an abnormal visual image; and an abnormal visual-image detection control section.

Still further, recently, since the toner, which is to be employed by the image forming apparatus, tends to be increasingly finer than ever in conjunction with the trend of achieving a high quality of the reproduced image, it becomes difficult to maintain the cleaning efficiency over a long term. On the other hand, in order to suppress a cost for a unit printing, it has been desired that the time for exchanging the cleaning section be made to delay later, so as to use the concerned cleaning section as longer as possible. In addition, in the conventional practice, the exchange time has been set at a predetermined timing (in conformity with the PM (Parts Management) cycle), or at such a time when a certain defects has appeared before the predetermined timing arrives, though the duration time (durable term) of the cleaning section depends on environmental factors. Accordingly, there has been desired such a system that makes it possible not only to maintain the cleaning efficiency as longer as possible, but also to suppress the wasted exchange of the cleaning section. Further, in such a image forming apparatus that is provided with the cleaning mechanisms in regard to both the intermediate transfer member and the secondary transferring member, there has arisen another problem that it takes much time for specifying a portion where the cleaning deficiency currently occurs.

Conventionally, Tokkai 2009-199036 (Japanese Patent Application Laid-Open Publication) sets forth a residual toner inspection apparatus that inspects the cleaning efficiency of the photoreceptor member abovementioned. The residual toner inspection apparatus concerned is provided with: a laser beam irradiating section to irradiate a laser beam in parallel onto an area in the vicinity of the viewing surface of the photoreceptor member concerned; and an observing section to observe scattering light generated by the abovementioned laser beam on the circumferential surface of the photoreceptor member.

However, since the defect inspection apparatus set forth in Tokkaihei 7-55710 conducts the inspection of the manufactured photoreceptor member before the photoreceptor member concerned is installed into the image forming apparatus, it is impossible to detect the scars or the like, which have been generated over time on the circumferential surface of the photoreceptor member.

Further, since the apparatus set forth in Tokkaihei 7-191580 detects a deterioration of the charging device by viewing a visual image, it is impossible to evaluate the cleaning efficiency.

Still further, since the residual toner inspection apparatus set forth in Tokkai 2009-199036 conducts the operation for evaluating the cleaning member of the image forming apparatus before the cleaning member concerned is installed into the image forming apparatus, it is impossible to evaluate the efficiency deteriorations of the cleaning member, which have been caused by the image forming cycles repeatedly conducted over time in the image forming apparatus concerned. In this connection, although the Tokkai 2009-199036 also sets forth that the residual toner inspection apparatus may be installed into an actual image forming apparatus, it would be practically difficult (or virtually impossible) to install the concerned apparatus into the actual image forming apparatus from a special factor and a cost effective points of view, since the observing operation is achieved by shifting the CCD (Charge Coupled Device) imager to be included in the observation section in an axis direction of the photoreceptor member (photoreceptor drum).

SUMMARY OF THE INVENTION

To overcome the abovementioned drawbacks in conventional image forming apparatus, it is one of objects of the present invention to provide an image forming apparatus, which makes it possible to reduce the frequency of image defect occurrences to a level as lower as possible by measuring the scars generated on the photoreceptor member with age and the aging change of cleaning efficiency.

Accordingly, at least one of the objects of the present invention can be attained by the image forming apparatus described as follows.

(1) According to an image forming apparatus reflecting an aspect of the present invention, the image forming apparatus that comprises: a photoreceptor member to form a toner image thereon; a charging section to electrically charge the photoreceptor member, an exposing section to expose the photoreceptor member charged by the charging section, so as to form a latent image thereon; a developing section to develop the latent image with toner so as to form the toner image on the photoreceptor member, a photoreceptor-member transferring section to transfer the toner image formed on the photoreceptor member onto a transfer medium; a cleaning section to remove residual toner remaining on the photoreceptor member, a light source that is disposed at a position located between the cleaning section and the charging section, to emit an inspection light, which is to be irradiated onto the photoreceptor member over a main-scanning direction thereof; a tight-contact type image sensor that has a line image sensor to receive the inspection light reflected from a surface of the photoreceptor member, and a control section to determine a status of the surface of the photoreceptor member, based on a result of analyzing the inspection light receive by the line image sensor.

(2) According to another aspect of the present invention, in the image forming apparatus recited in item 1, the control section makes judgments in regard to a scar generated on the surface of the photoreceptor member and/or a cleaning defect as an operation for determining the status of the surface of the photoreceptor member.

(3) According to still another aspect of the present invention, in the image forming apparatus recited in item 2, the control section makes the judgments in regard to the scar generated on the surface of the photoreceptor member during a period in which an image forming operation is deactivated.

(4) According to still another aspect of the present invention, in the image forming apparatus recited in item 2 or 3, when determining the status of the surface of the photoreceptor member, the control section determines an abnormality, which is periodically detected on the photoreceptor member, as the scar generated on the surface of the photoreceptor member.

(5) According to still another aspect of the present invention, in the image forming apparatus recited in any one of items 2-4, when determining that the scar is generated on the surface of the photoreceptor member as a result of the judgments, the control section implements controlling operations for requesting an operator to change the photoreceptor member to a new one.

(6) According to still another aspect of the present invention, in the image forming apparatus recited in any one of items 2-5, when determining that the cleaning defect is present on the surface of the photoreceptor member as a result of the judgments, the control section implements controlling operations for requesting an operator to change the cleaning section to a new one.

(7) According to still another aspect of the present invention, in the image forming apparatus recited in any one of items 2-6, when determining that the cleaning defect is present on the surface of the photoreceptor member as a result of the judgments, the control section implements controlling operations for recovering from the cleaning defect.

(8) According to still another aspect of the present invention, in the image forming apparatus recited in item 7, the controlling operations for recovering from the cleaning defect includes such an operation that temporarily makes the cleaning section apart from the surface of the photoreceptor member.

(9) According to still another aspect of the present invention, in the image forming apparatus recited in item 7 or 8, the photoreceptor member is shaped in a drum, a rotating action of which is controlled by the control section; and the controlling operations for recovering from the cleaning defect includes such an operation that temporarily makes a rotating direction of the photoreceptor member reverse to a normal rotating direction thereof.

(10) According to still another aspect of the present invention, in the image forming apparatus recited in any one of items 1-9, the light source also serves as an erasing lamp to eliminate a residual electric potential remaining on the photoreceptor member.

(11) According to still another aspect of the present invention, in the image forming apparatus recited in any one of items 1-10, the control section operates in either a normal operating mode or an adjustment operating mode; and in the normal operating mode, the control section determine the status of the surface of the photoreceptor member in such a state that the cleaning section press-contacts onto the surface of the photoreceptor member, and in the adjustment operating mode, the control section deactivates a transferring operation to be performed by the photoreceptor-member transferring section, and makes the cleaning section separate the surface of the photoreceptor member, and then, controls the light source to irradiate the inspection light onto the surface of the photoreceptor member, bearing the toner image thereon, and also controls the line image sensor to receive the inspection light reflected horn the surface of the photoreceptor member, so as to detect density unevenness of the toner image based on the result of analyzing the inspection light receive by the line image sensor.

(12) According to still another aspect of the present invention, in the image forming apparatus recited in item 11, the control section establishes a correction amount to be employed in an image forming operation, based on the density unevenness detected.

(13) According to yet another aspect of the present invention, in the image forming apparatus recited in item 11 or 12, the control section detects the density unevenness in at least any one of a main-scanning direction and a sub-scanning direction of the photoreceptor member.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
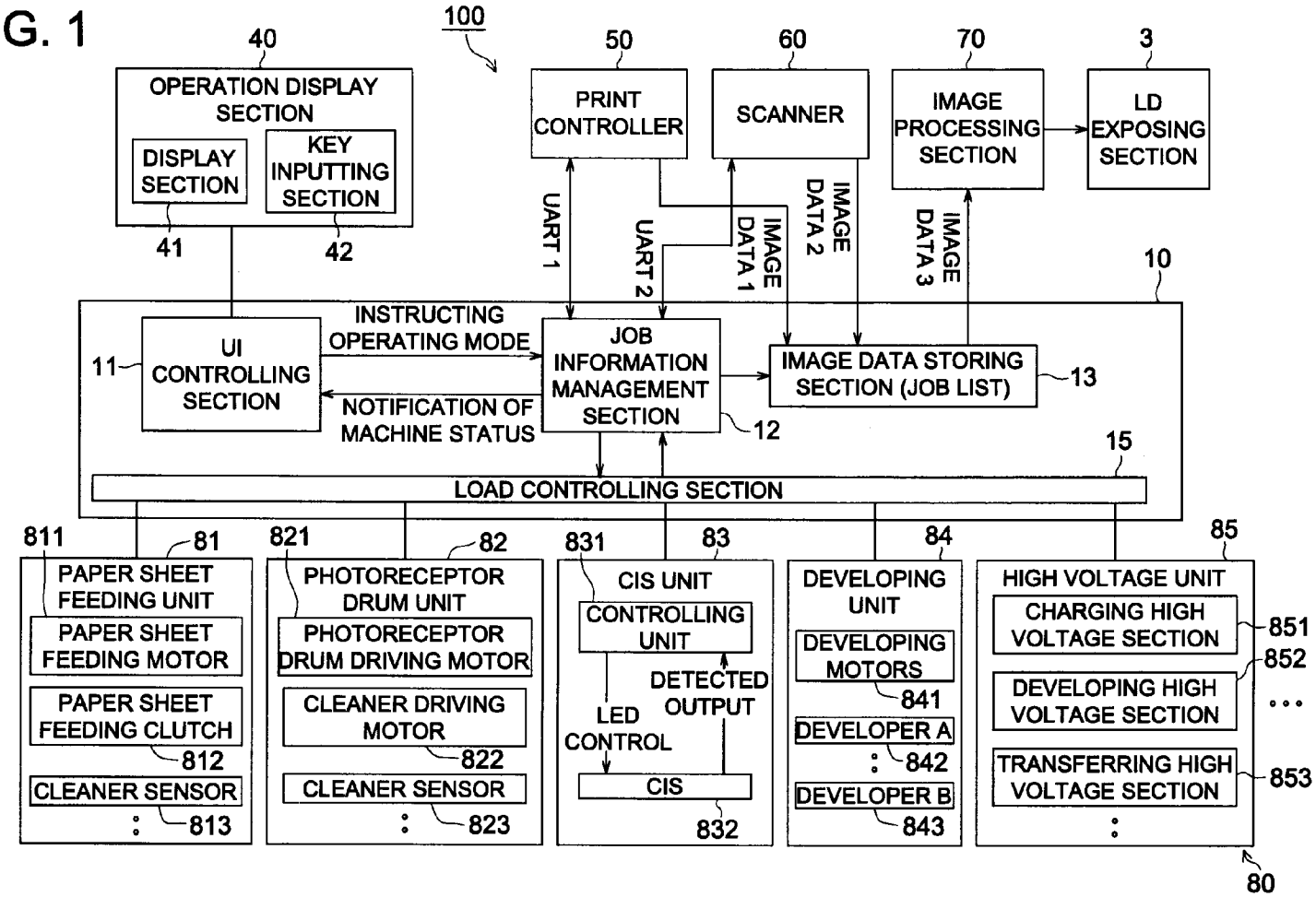
FIG. 1 shows a block diagram indicating a configuration of an image forming apparatus embodied in the present invention.

Referring to the drawings, a preferred embodiment will be detailed in the following. Initially, referring to FIG. 1, a configuration of an image forming apparatus 100, embodied in the present invention, will be detailed in the following. FIG. 1 shows a block diagram indicating the configuration of the image forming apparatus 100 embodied in the present invention.

As indicated by the block diagram shown in FIG. 1, the image forming apparatus 100 comprises: a control section 10; an operation display section 40; a print controller 50; a scanner 60; an image processing section 70; and an image forming section 80.

The control section 10 totally controls various kinds of sections provided in the image forming apparatus 100. Concretely speaking the control section 10 is provided with a CPU (Central Processing Unit) (not shown in the drawings); a nonvolatile storage (not shown in the drawings) to store various kinds of data in a readable and writable manner; image data and job data, based on which an image is formed on a paper sheet; and an image data storing section 13 to store a job list therein. The control section 10 reads designated program data from various kinds of program data stored in a ROM (Read Only Memory) (not shown in the drawings) and develops the designated program data on a RAM (Random Access Memory) (not shown in the drawings), so as to implement various kinds of processing for totally controlling each of the sections in conjunction with the CPU that executes the program data currently developed on the RAM concerned. Concretely speaking the control section 10 totally controls the processing to be conducted by each of the sections for implementing the image forming operations in the image forming apparatus 100. The control section 10 concerned serves as a control section embodied in the present invention.

Further, in conjunction with the CPU that executes the program data abovementioned, the control section 10 also serves as a UI (User Interface) controlling section 11, a job information management section 12 and a load controlling section 15.

The UI controlling section 11 conducts bilateral communicating operations between the operation display section 40 and the job information management section 12, so as to control the operations to be conducted by the operation display section 40 concerned. Concretely speaking the UI controlling section 11 implements the display controlling operations for the information display screen or the like, on which various kinds of screens, such as an operation screen, a setting screen, an apparatus status screen, etc., are displayed. The apparatus statuses to be displayed on the information display screen or the like by the UI controlling section 11 also include a screen for indicting a current status of the circumferential surface of the photoreceptor member, detailed later, and another screen for requesting the exchange of the photoreceptor drum and the cleaning section. Further, the UI controlling section 11 accepts the operational instruction inputted from the operation display section 40 on the displayed screen above-mentioned.

The print controller 50 transmits data to the job information management section 12 through a transmission line UART1, while the scanner 60 transmits data to the job information management section 12 through a transmission line UART2, so as to input the data therein. Further, the job information management section 12 stores job data, such as an image forming instruction inputted from the operation display section 40 through the UI controlling section 11, etc., and the image data, representing the image to be formed, into the image data storing section 13 so as to manage them.

The job data to be managed by the job information management section 12 includes various kinds of data indicating detailed instructions for forming images based on the image data concerned, such as a designation of a duplex or one side printing, a designation of a kind of paper sheet, a designation of a paper sheet feeding tray to be employed, a designation of a unicolor or multicolor printing mode, a designation of a size of paper sheet, a designation of pages to be printed, a designation of a number of copies, etc.

The load controlling section 15 is coupled to a paper sheet feeding unit 81, a photoreceptor drum unit 82, a CIS unit 83, a developing unit 84, a high voltage unit 85, etc., so as to control these loads under the controlling actions conducted by the control section 10. According to this configuration, the load controlling section 15 sequentially implements a plurality of operating modes including a normal operating mode, an adjustment operating mode, etc.

In this connection, the paper sheet feeding unit 81 is provided with: a paper sheet feeding motor 811 to feed a paper sheet from the paper sheet feeding tray; a paper sheet feeding clutch 812 to transmit the driving power generated by the paper sheet feeding motor 811 to a paper sheet feeding miler (not shown in the drawings); and a paper sheet feeding sensor 813 to detect a paper sheet to be fed; etc.

The photoreceptor drum unit 82 is provided with: a photoreceptor drum driving motor 821 to rotate the photoreceptor drum; a cleaner driving motor 822 to drive the cleaner serving as a cleaning section; a cleaner sensor 823 to detect a separation or approach of the cleaner relative to the photoreceptor drum; etc.

The CIS unit 83 is provided with a controlling unit 831 and a CIS 832. The CIS 832 is constituted by: an LED (Light Emitting Diode) light source 7, including an LED for irradiating an inspection use light onto a photoreceptor drum 1 over a main-scanning direction of the photoreceptor drum 1, detailed later; and a line image sensor 8 that receives the light reflected from the photoreceptor drum 1. The CIS 832 is equivalent to a tightly contacting type image sensor recited in the claimed present invention. The CIS configuration of the light source and the line image sensor makes it easy to detect the status of the circumferential surface of the photoreceptor drum 1 in a narrow peripheral space around the photoreceptor drum 1 concerned.

The controlling unit 831 controls the operation for turning ON or OFF the LED light source 7, and receives the detected signals outputted by the line image sensor 8. The detected signals are further transmitted to the control section 10 so as to determine the current status of the circumferential surface of the photoreceptor drum 1.

The developing unit 84 is provided with developing motors 841 respectively corresponding to each of the unicolors, in order to feed developer 842 and developer 843 for each of unicolors (represented by developer A and developer B in the drawing) to the photoreceptor drum 1.

The high voltage unit 85 totally controls the high voltage generating sections, including a charging high voltage section 851, a developing high voltage section 852 and a transferring high voltage section 853, which are provided in the image forming section 80.

The photoreceptor drum unit 82, developing unit 84, high voltage unit 85, abovementioned, and an exposing section 3 are included in the image forming section 80.

The operation display section 40 is provided with a display section 41 and a key inputting section 42. The display section 41 includes a display screen, such as an LCD (Liquid Crystal Display), etc. The key inputting section 42 includes various kinds of operational keys, such as numeral keys, various kinds of start keys, various kinds of function keys for conducting various kinds of setting operations, etc. In this connection, it is also applicable that the operation display section 40 is configured as a touch panel in which the display section 41 and the key inputting section 42 are integrally formed. The touch panel accepts operating instructions inputted from the user by detecting positions contacted by the user's finger tip, a touch pen or the like. The operation display section 40 conducts the operation for transmitting/receiving data to/from the UI controlling section 11, so as to implement the operation for displaying various kinds of images onto the display section 41. In addition, the operation display section 40 outputs the operating instruction inputted from the key inputting section 42 to the UI controlling section 11, by conducting the operation for transmitting/receiving data to/from the UI controlling section 11.

Next, referring to FIG. 2*a*, FIG. 2*b* and FIG. 2*c*, the display screens to be displayed on the display section 41 of the operation display section 40 and the setting operations to be inputted from the key inputting section 42, under the controlling actions issued by the UI controlling section 11, will be detailed in the following. In this connection, the inputting operations from the display section 41 are enabled, so as to include the function of the key inputting section 42 therein.

Figure 2A:
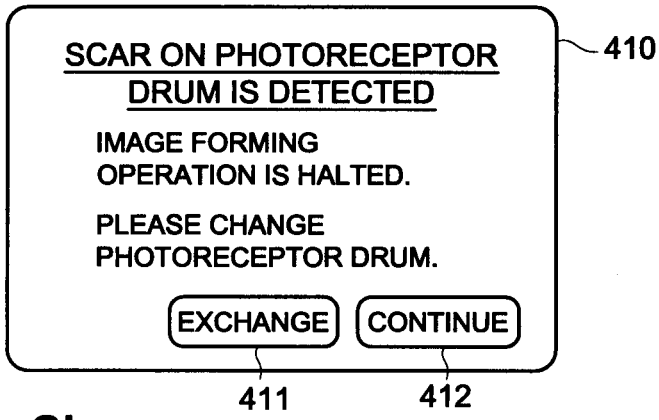
FIG. 2*a* shows a schematic diagram indicating a warning screen embodied in the present invention.

FIG. 2*a* shows a schematic diagram indicating a warning screen 410 to be displayed at the time when a scar residing on the circumferential surface of the photoreceptor drum is detected in the status determining operation for the circumferential surface of the photoreceptor drum, detailed later. Within the warning screen 410 to be displayed on the display section 41, an exchange instruction button 411 for instructing the implementation of the exchanging work and a continuation instruction button 412 for instructing the continuation of the image forming operation, irrespective of the warning message displayed thereon, are displayed, so that the user can selectively depress any one of the exchange instruction button 411 and the continuation instruction button 412.

Figure 2B:
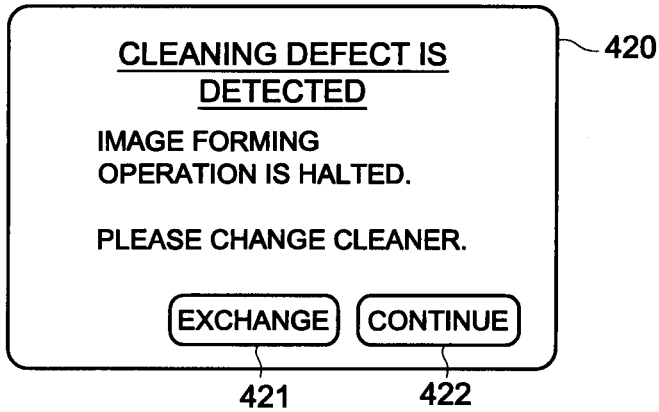
FIG. 2*b* shows a schematic diagram indicating another warning screen embodied in the present invention and FIG. 2*c* shows a schematic diagram indicating a mode selection screen embodied in the present invention, which are to be displayed on a display section.

FIG. 2*b* shows a schematic diagram indicating another warning screen 420 to be displayed at the time when a cleaning defect is detected in the status determining operation for the circumferential surface of the photoreceptor drum, detailed later. Within the warning screen 420 to be displayed on the display section 41, an exchange instruction button 421 for instructing the implementation of the exchanging work and a continuation instruction button 422 for instructing the continuation of the image forming operation, irrespective of the warning message displayed thereon, are displayed, so that the user can selectively depress any one of the exchange instruction button 421 and the continuation instruction button 422.

Figure 2C:
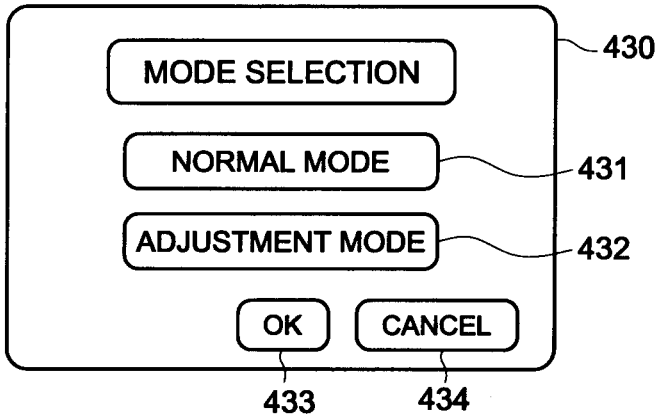

FIG. 2*c* shows a schematic diagram indicating a mode selection screen 430 for determining whether the operations of the image forming apparatus should be implemented in a normal mode or an adjustment mode. Within the mode selection screen 430, a normal mode selection button 431 for instructing the implementation of the normal mode and an adjustment mode selection button 432 for instructing the implementation of the adjustment mode, are displayed, and further, an OK button 433 and a cancel button 434 are also displayed, so that the user can selectively depress any one of the normal mode selection button 431 and the adjustment mode selection button 432, and any one of the OK button 433 and the cancel button 434. When the user depresses any one of the normal mode selection button 431 and the adjustment mode selection button 432, the image forming operations are implemented in the selected operation mode. When the user depresses the cancel button 434, the selection of the depressed operation mode is cancelled.

Figure 3:
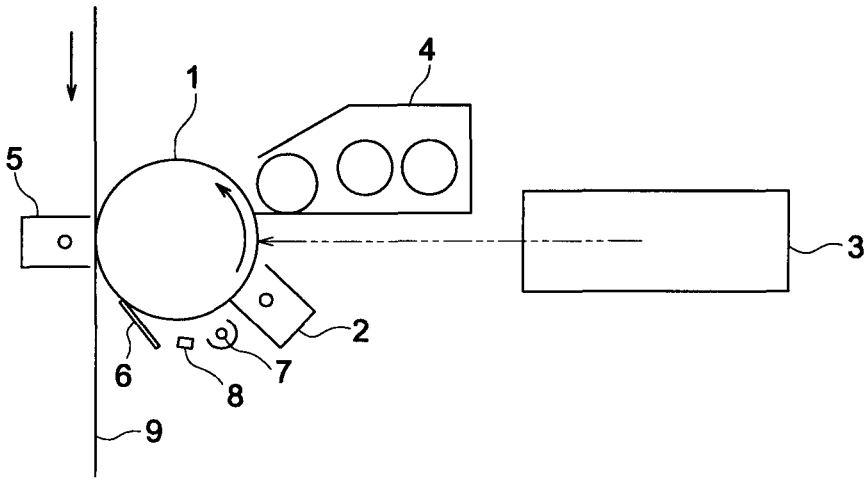
FIG. 3 shows a schematic diagram indicating a structural arrangement of various kinds of sections to be disposed in a peripheral space around the image forming section, embodied in the present invention.

Next, referring to FIG. 3, a structural arrangement of various kinds of sections to be disposed in a peripheral space around the image forming section, will be detailed in the following. A charging section 2, the exposing section 3, a developing section 4, a photoreceptor-drum transferring section 5 and a cleaning section 6 are sequentially disposed in a peripheral space around the circumferential surface of the photoreceptor drum 1 shaped in a cylindrical drum, according to the rotating direction thereof. Further, the LED light source 7 for irradiating the inspection light onto the circumferential surface of the photoreceptor drum 1 and the line image sensor 8 for receiving the inspection light reflected from the circumferential surface of the photoreceptor drum 1 are also disposed in a special section between the cleaning section 6 and the charging section 2. The LED light source 7 and the line image sensor 8 constitute the CIS 832, which is included in the CIS unit 83. Further, the LED light source 7 is equivalent to the light source, embodied in the present invention.

Further, an intermediate transfer belt 9 is disposed at a gap formed between the photoreceptor drum 1 and the photoreceptor-drum transferring section 5, and is pressed onto the circumferential surface of the photoreceptor drum 1 at the time of implement the transferring operation, so as to transfer the image formed on the photoreceptor drum 1 onto the intermediate transfer belt 9.

A color image forming apparatus is provided with a plurality of image forming sections respectively corresponding to a plurality of unicolors, serving as, for instance, primary colors constituting a full color image, and is so constituted that the intermediate transfer belt 9 press-contacts each of the photoreceptor drums respectively included in the image forming sections.

The image (full color toner image) transferred onto the intermediate transfer belt 9 is further transferred onto the paper sheet by a transferring action to be implemented at a secondary transferring section, (not shown in the drawings).

Figure 4A:
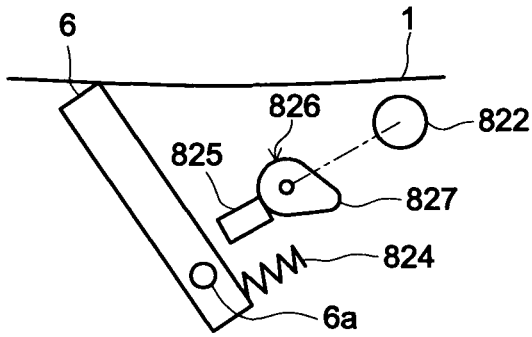
FIG. 4*a* and FIG. 4*b* show explanatory schematic diagrams indicating a separating/contacting mechanism for moving the cleaning section, embodied in the present invention.
Figure 4B:
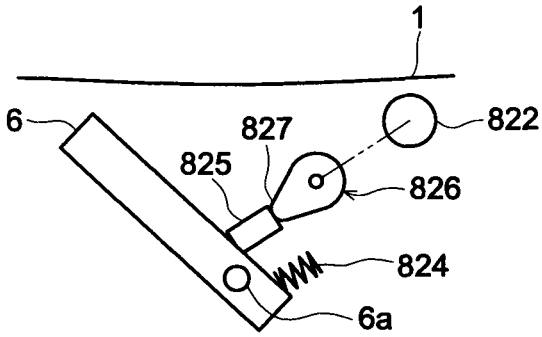

FIG. 4*a* and FIG. 4*b* show explanatory schematic diagrams indicating a separating/contacting mechanism for moving the cleaning section 6 abovementioned with respect to the photoreceptor drum 1.

The cleaning section 6 includes a leading edge portion for contacting the circumferential surface of the photoreceptor drum 1 and a base edge portion located opposite to the leading edge portion, and is rotationally supported by a supporting shaft section 6*a* located near the base edge portion. A pressure member 824, such as a coil spring, etc., applies a pressing force to the base edge portion of the cleaning section 6 so as to generate a rotational force for rotating the cleaning section 6 towards the photoreceptor drum 1, and as a result, the leading edge portion pressure-contacts the circumferential surface of the photoreceptor drum 1.

Further, a cleaning section press-back member 825, which is capable of both separating and contacting actions from/to the cleaning section 6, is disposed at a position being slightly shifted towards the leading edge portion from the position of the supporting shaft section 6*a*. Still further, a cam member 826 is disposed at an end side (being opposite side of the cleaning section 6) of the cleaning section press-back member 825 in a rotatable manner. The cam member 826 concerned is driven to rotate by a cleaner driving motor 822.

In such a state that the cleaning section press-back member 825 and a cam section 827 formed in the cam member 826 does not contact with each other, the cleaning section press-back member 825 is located at such a position that is apart from the cleaning section 6. Accordingly, since the pressing force is applied to the base end portion of the cleaning section 6, the cleaning section 6 rotates around the supporting shaft section 6*a*, serving as the center of the rotation, so as to make the leading edge portion of the cleaning section 6 press-contact the circumferential surface of the photoreceptor drum 1. As a result, this state makes it possible to perform the operation for cleaning the circumferential surface of the photoreceptor drum 1.

On the other hand, in such a state that the cam section 827 of the cam member 826 is pushing the cleaning section press-back member 825 forward, the cleaning section press-back member 825 presses the cleaning section 6 backward, so as to rotate the cleaning section 6 against the pressing force applied by the pressure member 824, in such a manner that the leading edge side of the cleaning section 6 is made to be apart from the circumferential surface of the photoreceptor drum 1. According to the abovementioned process, the separating and contacting actions of the cleaning section 6 against the photoreceptor drum 1 is achieved. The rotating action of the can member 826 is driven by the cleaner driving motor 822, while the operations of the cleaner driving motor 822 is controlled by the load controlling section 15 of the control section 10.

Figure 5A:
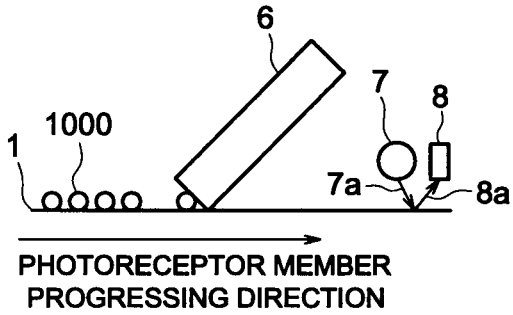
FIG. 5*a* and FIG. 5*b* show explanatory schematic diagrams indicating states of cleaning actions to be conducted by a cleaning section, embodied in the present invention.
Figure 5B:
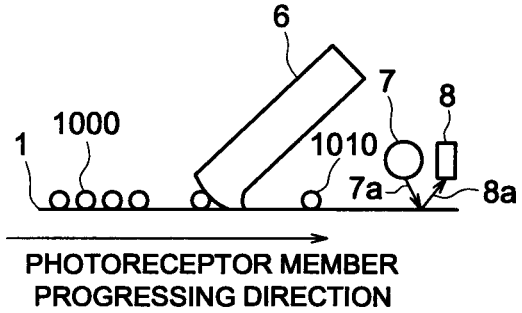

When the cleaning section 6 abovementioned is pressed onto the circumferential surface of the photoreceptor drum 1, the residual toner remaining on the circumferential surface of the photoreceptor drum 1 are removed, while the current status of the circumferential surface is detected by the combination of the LED light source 7 and the line image sensor 8. At the same time, the exposing action performed by the light emitted from the LED light source 7 of the line image sensor 8 also serves as an operation for removing the residual charge currently residing on the circumferential surface of the photoreceptor drum 1. Referring to FIG. 5*a* and FIG. 5*b*, the state of the abovementioned operations will be detailed in the following. In this connection, the schematic diagrams shown in FIG. 5*a* and FIG. 5*b* are conceptually depicted for the sake of explanation.

As shown in FIG. 5*a*, when the cleaning section 6 is pressed onto the circumferential surface of the photoreceptor drum 1, toner 1000 remaining on the circumferential surface of the photoreceptor drum 1 are removed therefrom, and then, the charging operation is applied to the photoreceptor drum 1 at the downstream side of the cleaning section 6 in the state that the toner 1000 are removed from the photoreceptor drum 1. However, if an abnormal deformation or the like of the cleaning section 6, caused by the deterioration or the like of the material of the cleaning section 6, is generated, a part of toner 1000 slips through the press-contacting portion, and moves to the downstream side, while still adhering onto the circumferential surface of the photoreceptor drum 1. Residual toner 1010 concerned will be transferred onto the paper sheet, and therefore, cause an abnormal image at the time when the image forming operation is performed later on.

The abovementioned abnormality is detected at a regional section between the cleaning section 6 and the charging section 2 by determining the status of the circumferential surface of the photoreceptor drum 1. In order to detect the status of the circumferential surface of the photoreceptor drum 1, the LED light source 7 emits an inspection light 7*a* over the main-scanning direction of the photoreceptor drum 1, and the line image sensor 8 receives a reflected light 8*a* reflected therefrom. Accordingly, by respectively setting the lengths of the LED light source 7 and the line image sensor 8 in the main-scanning direction at appropriate values, it becomes possible to detect the status of the circumferential surface of the photoreceptor drum 1 over a necessary length in the main-scanning direction. It is desirable, however, that the operations of irradiating the inspection light 7*a* and receiving the reflected light 8*a* are conducted over the overall width of the photoreceptor drum 1.

Further, according to the abovementioned operation for determining the status of the circumferential surface of the photoreceptor drum 1, it is possible to include a scar generated on the photoreceptor drum 1 into the objects of the abnormality determining operation.

Figure 6A:
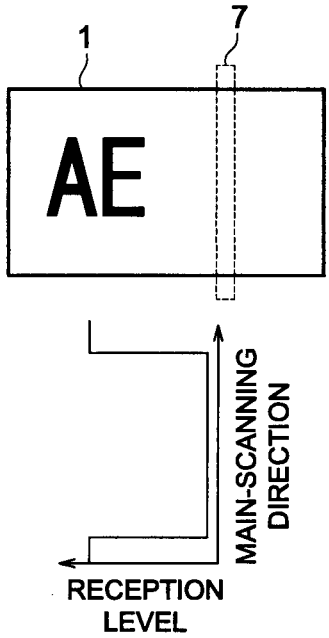
FIG. 6*a* and FIG. 6*b* show explanatory schematic diagrams indicating states of detecting operations to be conducted by a combination of a light source and a line image sensor, embodied in the present invention.
Figure 6B:
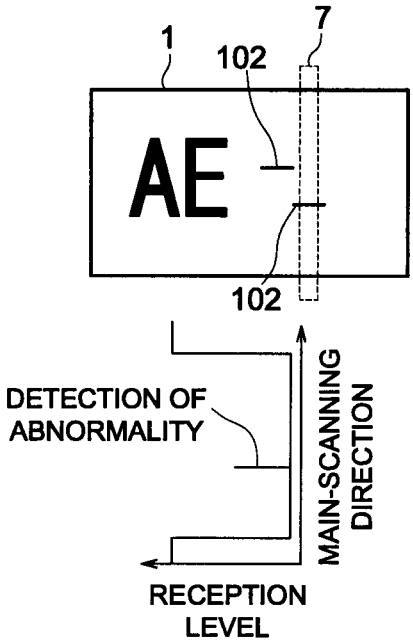

FIG. 6*a* and FIG. 6*b* show explanatory schematic diagrams indicating a detecting state when determining the status of the circumferential surface of the photoreceptor drum 1, as abovementioned. In this connection, the photoreceptor drum 1 is depicted as a flat panel for illustrative purposes, and the indication of the cleaning section 6 is omitted.

On the circumferential surface of the photoreceptor drum 1, a toner image is formed and transferred onto the paper sheet, and after cleaning operation has been completed, the LED light source 7 irradiates the inspection light 7*a* onto the overall region in the main-scanning direction and the line image sensor 8 (not shown in FIG. 6) receives the reflected light 8*a*. When no image and no scar reside on the circumferential surface of photoreceptor drum 1, the control section 10 sets a reception level of the reflected light 8*a* at "Low", while, when an abnormality, such as an image, a scar, etc., is detected from the circumferential surface of photoreceptor drum 1, the reception level becomes high corresponding to an amount of the reflected light 8*a*, and the control section 10 sets the reception level of the reflected light 8*a*, which represents an image having 100% density, at "High".

The schematic diagram shown in FIG. 6*a* indicates such a state that the cleaning section 6 completes the cleaning operation without generating the residual toner 1010, and the control section 10 sets a reception level of the reflected light 8*a* at "Low".

On the other hand, the schematic diagram shown in FIG. 6*b* indicates such a state that an abnormality 1020, such as the residual toner 1010, etc., has been generated on the circumferential surface of the photoreceptor drum 1. The reception level of the reflected light 8*a*, detected by the line image sensor 8, is raised in response to the abnormality 1020, and accordingly, the abnormality detecting operation is achieved.

Figure 7:
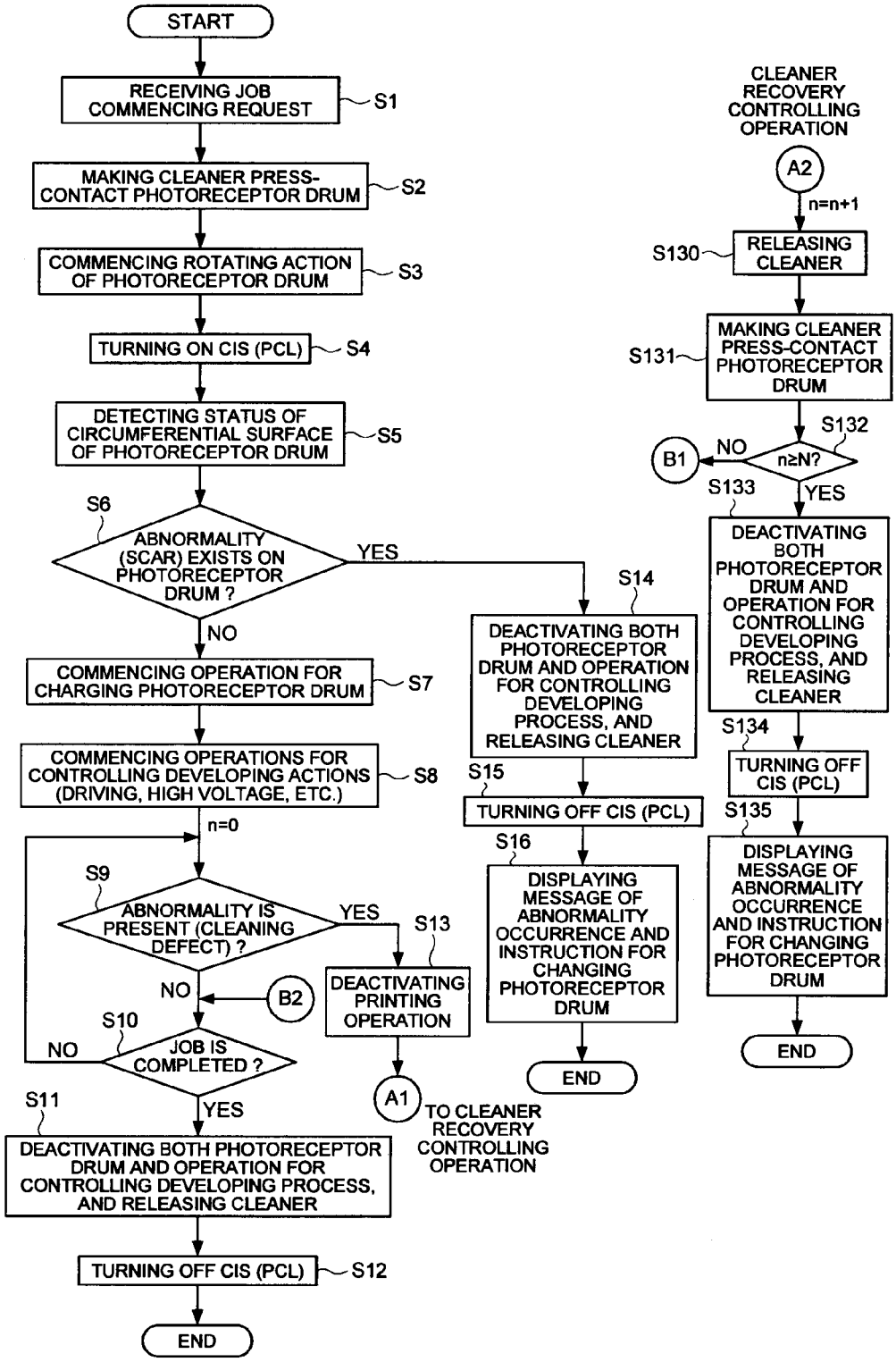
FIG. 7 show a flowchart indicating a processing procedure for determining a status of a circumferential surface of a photoreceptor drum, embodied in the present invention.

Next, referring to the flowchart shown in FIG. 7, the processing procedure for determining the status of the circumferential surface of the photoreceptor drum 1 will be detailed in the following. The processing procedure concerned is performed under the controlling operations conducted by the control section 10.

Initially, when receiving a JOB commencing request (Step S1), the control section 10 activates the cleaner driving motor 822 so as to make the cleaning section 6 (cleaner) contact the circumferential surface of the photoreceptor drum 1 with pressure (Step S2).

In this connection, although, in the processing procedure to be described in the following, the cleaner pressing operation is conducted associated with the implementation of the JOB concerned, and the cleaner releasing operation is conducted associated with the completion of the JOB concerned, it is also applicable in the present invention that the cleaner pressing operation is always conducted in the normal operation mode, irrespective of whether or not a JOB is currently implemented.

Returning to the flowchart, after completing the operation in Step S2, the control section 10 activates the photoreceptor drum driving motor 821 to commence the rotating action of the photoreceptor drum 1 (Step S3), and turns ON the LED light source 7 of the CIS unit 83 also serving as the erasing lamp (PCL), so as to irradiate the inspection light 7*a* onto the circumferential surface of the photoreceptor drum 1 (Step S4). In the CIS unit 83, the line image sensor 8 receives the reflected light 8*a* reflected from the circumferential surface of the photoreceptor drum 1, and the controlling unit 831 applies a data processing to the received data so as to transmit the processed data, representing the result of receiving the reflected light 8*a*, to the control section 10. Successively, based on the processed data received, the control section 10 detects the status of the circumferential surface of the photoreceptor drum 1 in order to determine presence or absence of the abnormality (Step S5).

The abovementioned operation for determining the presence or absence of the abnormality has been performed during a period before the image forming operation is actually implemented, and therefor; it is possible to determine existence or non-existence of a scar on the circumferential surface of the photoreceptor drum 1. Accordingly, the operation for determining whether or not an abnormality (scar) exists on the photoreceptor drum 1 is performed according to the abovementioned abnormality detecting process (Step S6). When determining that an abnormality (scar) exists (Step S6; Yes), since it can be assumed that a kind of scar possibly resides on the circumferential surface of the photoreceptor drum 1, the control section 10 deactivates both the rotating action of the photoreceptor drum 1 and the operation for controlling the developing actions, and then, activates the cleaner driving motor 822 so as to make the cleaning section 6 (cleaner) separate from the photoreceptor drum 1 (Step S14). Successively, the control section 10 turns OFF the LED light source 7 of the CIS unit 83, and deactivates the operation for detecting the status of the circumferential surface of the photoreceptor drum 1, which is to be conducted by the control section 10, itself; (Step S15).

Still successively, after turning OFF the CIS unit 83 abovementioned, the control section 10 makes the display section 41 of the operation display section 40 display a message for indicating the occurrence of the abnormality and the instruction for changing the photoreceptor drum, thereon (Step S16), and then, finalizes the processing. FIG. 2*a* shows a schematic diagram indicating an example of the message concerned. As shown in FIG. 2*a*, the message of "SCAR ON PHOTORECEPTOR DRUM IS DETECTED" is displayed as the indication of the abnormality occurrence, and the message of "PLEASE CHANGE PHOTORECEPTOR DRUM" is displayed as the instruction for changing the photoreceptor drum, thereon.

When determining that no abnormality (scar) exists, or no abnormality is detected on the circumferential surface of the photoreceptor drum 1 (Step S6; No), the control section 10 controls the charging high voltage section 851 disposed at the charging section 2 so as to commence the operation for charging the photoreceptor drum 1 (Step S7), and further, commences controlling operations for driving the developing motors 841, and for activating the developing actions of the developing high voltage section 852, etc., (Step S8). Associating with the commencement of the image forming operation, the control section 10 resets a current value of an abnormality occurrence counter at zero, and sets a number of "N" times as a threshold value of an abnormality occurrence frequency. The number of "N" times can be arbitrarily set at an appropriate value as needed, depending on a degree of final image quality desired by the user. Further, the number of "N" times is normally established as an initial value, so as to employ it by reading from a storage section or the like.

Associating with the implementation of the image forming operation, the CIS unit 83 performs the detecting operation. Concretely speaking, the inspection light 7*a*, irradiated from the LED light source 7, is reflected from the circumferential surface of the photoreceptor drum 1, and the reflected light 8*a* is received by the line image sensor 8, and then, the processed data, representing the result of receiving the reflected light 8*a*, is transmitted to the control section 10. Receiving the processed data sent from the CIS unit 83, the control section 10 detects the status of the circumferential surface of the photoreceptor drum 1 in order to determine presence or absence of the abnormality, based on the received data, (Step S9). In this connection, since it is premised in this determining operation that no scar is generated on the circumferential surface of the photoreceptor drum 1, when determining that an abnormality is present, the abnormality is regarded as a cleaning defect. Further, since the photoreceptor drum 1 can be discharged by irradiating the inspection light 7*a*, emitted from the LED light source 7, onto the circumferential surface of the photoreceptor drum 1, the LED light source 7 also serves as an erasing lamp.

When determining that no abnormality is present as a result of the determining operation in Step S9 (Step S9; No), the control section 10 repeats the image forming operation and the operation for determining the status of the circumferential surface of the photoreceptor drum 1, until the JOB is completed (Step S10).

Concretely speaking, associating with the image forming operation, the consecutive operations, including the charging operation performed by the charging section 2, the writing operation performed by the exposing section 3, the developing operation performed by the developing section 4, the transferring operation onto the intermediate transfer belt 9 performed by the photoreceptor-drum transferring section 5 and the cleaning operation performed by the cleaning section 6, are sequentially applied to the photoreceptor drum 1.

After the JOB is completed, the control section 10 deactivates both the rotating action of the photoreceptor drum 1 and the operation for controlling the developing actions, and then, activates the cleaner driving motor 822 so as to make the cleaning section 6 (cleaner) separate from the photoreceptor drum 1 (Step S11). Successively, the control section 10 turns OFF the LED light source 7 of the CIS unit 83, and deactivates the operation for detecting the status of the circumferential surface of the photoreceptor drum 1, which is to be conducted by the control section 10, itself (Step S12), so as to finalize the processing.

When determining that an abnormality is present as a result of the determining operation implemented in the CIS unit 83 in Step S9 (Step S9; Yes), the control section 10 regards the abnormality as a cleaning defect, and deactivates the printing (image forming) operation (Step S13), and then, sifts the processing flow to the cleaner recovery control processing (shifting from node A1 to node A2 in the flowchart).

In the cleaner recovery control processing, the control section 10 incrementally increases the currently counted number "n" of the abnormality occurrence counter to the updated number "n+1", and activates the cleaner driving motor 822 so as to release the cleaner (Step S130). Concretely speaking, the cam member 826 is rotated by the driving action of the cleaner driving motor 822, so that the cleaning section press-back member 825 is made to move towards the cleaning section 6 by the pressing force of the cam section 827 so as to depress the cleaning section 6. As a result, the cleaning section 6 is made to separate from the circumferential surface of the photoreceptor drum 1.

Successively, the control section 10 further activates the cleaner driving motor 822 so as to make the cleaner press the photoreceptor drum 1 (Step S131). Concretely speaking, the cam member 826 is rotated by the driving action of the cleaner driving motor 822, so as to make the cam section 827 release the pressing action applied to the cleaning section press-back member 825. As a result, the pressure member 824 depresses the cleaning section 6, so as to make the leading edge side of the cleaning section 6 press the circumferential surface of the photoreceptor drum 1.

According to the abovementioned process, it becomes possible to eliminate the abnormal deformation or the like to be generated in the cleaning section 6. Still successively, the control section 10 determines whether or not the counted number of the abnormality occurrence counter reaches to the "N" times (Step S132). When determining that the counted number concerned has not reached to the "N" times (Step S132; No), the control section 10 make the processing flow return to node B2 (shifting from node B1 to node B2 in the flowchart), namely, return to the processing for determining the status of the circumferential surface of the photoreceptor drum 1, which is to be conducted by the CIS unit 83.

On the other hand, when determining that the counted number concerned has reached to the "N" times (Step S132; Yes), the control section 10 deactivates both the rotating action of the photoreceptor drum 1 and the operation for controlling the developing actions, and then, conducts the processing for releasing the cleaner (Step S133). Successively, the control section 10 turns OFF the LED light source 7 of the CIS unit 83, and deactivates the operation for detecting the status of the circumferential surface of the photoreceptor drum 1, which is to be conducted by the control section 10, itself, (Step S134). After turning OFF the CIS unit 83 abovementioned, the control section 10 makes the display section 41 of the operation display section 40 display a message for indicating the occurrence of the abnormality and the instruction for changing the photoreceptor drum, thereon (Step S135), and then, finalizes the processing. FIG. 2*b* shows a schematic diagram indicating an example of the message concerned. As shown in FIG. 2*b*, the message of "CLEANING DEFECT IS DETECTED" is displayed as the indication of the abnormality occurrence, and the message of "PLEASE CHANGE CLEANER" is displayed as the instruction for changing the cleaner, thereon.

According to the abovementioned processing flow embodied in the present invention, it becomes possible to determine the time of replacing the photoreceptor drum or the cleaning section more appropriately than ever. Further, it also becomes possible to recover the cleaning defect so as to make the usable life of the cleaning section longer than ever.

Figure 8:
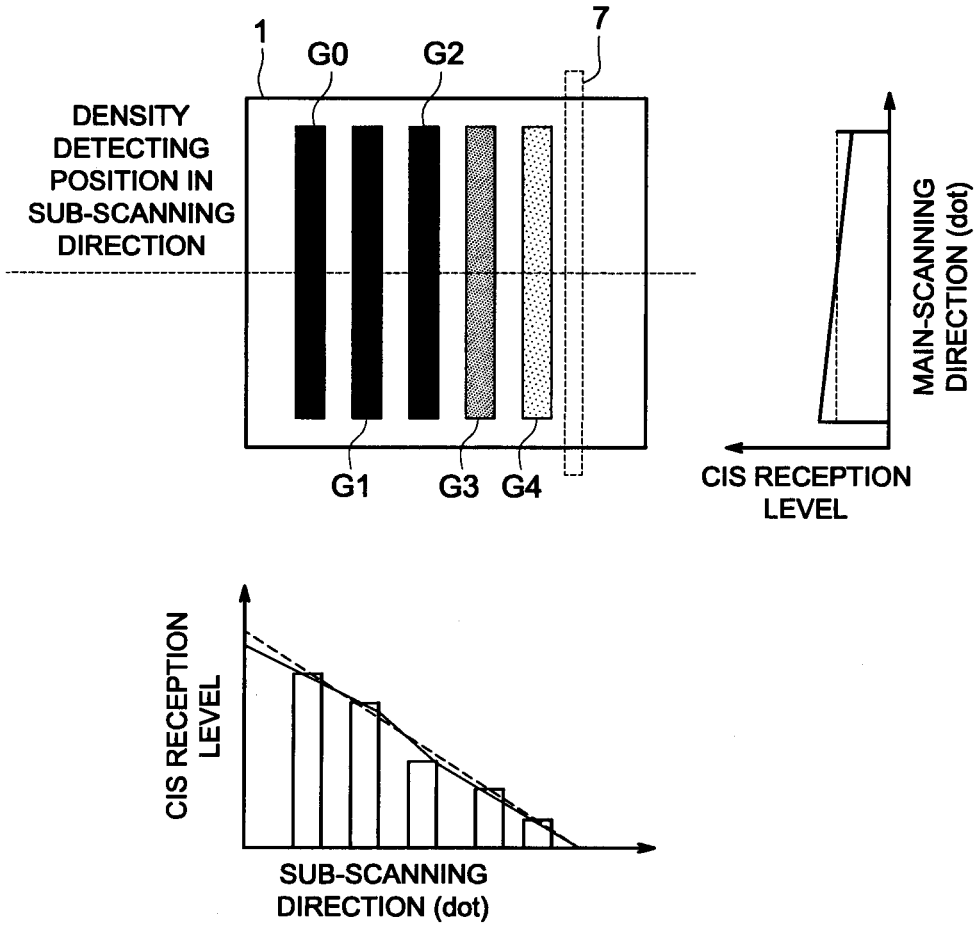
FIG. 8 shows an explanatory schematic diagram indicating a state of density unevenness of an image formed on a circumferential surface of a photoreceptor drum, embodied in the present invention.

Further, other than the operation for determining an abnormality on the circumferential surface of the photoreceptor drum, the CIS unit 83 abovementioned can be also utilized as such a unit that can determine a density unevenness of an image. Referring to FIG. 8, the application for the abovementioned purpose will be detailed in the following.

The CIS unit 83 detects the status of the circumferential surface of the photoreceptor drum 1 onto which inspection-use image patterns G0 through G4, densities of which are different from each other, are formed, without applying the cleaning operation to be conducted by the cleaning section 6. Concretely speaking, the inspection light 7*a* emitted from the LED light source 7 is irradiated onto the circumferential surface of the photoreceptor drum 1 onto which the concerned image is formed, and then, the line image sensor 8 receives the reflected light 8*a* reflected therefrom. The data, representing the result of receiving the reflected light 8*a*, is transmitted to the control section 10, so that the control section 10 determines the degree of the density unevenness based on the received data.

Since an amount of reflected light, reflected from the circumferential surface of the photoreceptor drum 1, varies depending on the density of an image, it is possible to determine the degree of the density unevenness on the basis of the amount of reflected light. Since the line image sensor 8 can receives the reflected light over the main-scanning direction of the photoreceptor drum 1, it is possible to detect the density unevenness in the main-scanning direction on the basis of the reception level of the reflected light in the main-scanning direction. FIG. 8 shows a schematic diagram indicating an example of the receiving result in the main-scanning direction. A target image density to be employed for the image forming operation is established in advance. Accordingly, by correcting the image forming operation in the main-scanning direction on the basis of the difference between the image density actually detected and the target image density established in advance, it becomes possible to implement the image forming operation more appropriately than ever.

Further, as shown in FIG. 8, by measuring an image density corresponding to each of the inspection-use image patterns G0 through G4, it becomes possible to acquire data representing the result of the measuring the image density in the sub-scanning direction. Even for this measuring result in regard to the sub-scanning direction, a target image density to be employed for the image forming operation is established in advance, as well. Accordingly, by correcting the image forming operation in the sub-scanning direction on the basis of the difference between the image density actually detected and the target image density above-established, it becomes possible to implement the image forming operation more appropriately than ever.

In this connection, although the abovementioned example is so constituted that the density unevenness is detected from the inspection-use image patterns formed on the photoreceptor drum, it is also applicable that the system is so constituted that the density unevenness is detected by using a certain image formed through a normal image forming process.

Further, it is possible for the operator to select any one of an adjustment operating mode in which the abovementioned density unevenness is detected and a normal operating mode in which the normal image forming operation and the operation for determining the status of the circumferential surface of the photoreceptor drum 1 are implemented, so as to actually implement any one of the adjustment operating mode or the normal operating mode.

FIG. 2*c* shows a schematic diagram indicating an example of the mode selection screen 430 to be displayed on the operation display section 40 when the operator conducts the selecting operation abovementioned.

Within the mode selection screen 430, the normal mode selection button 431 and the adjustment mode selection button 432 are displayed in a depress-able manner. When the adjustment mode selection button 432 is depressed, and then, the OK button 433 is depressed, the image forming apparatus 100 enters into the adjustment operating mode. In this connection, at the initial operating time, the image forming apparatus 100 is operated in the normal operating mode and it is possible for the operator to select a specific item for displaying the mode selection screen 430 from items displayed in a setting screen or the like (not shown in the drawings), so as to select the adjustment operating mode abovementioned. Further, after the image forming apparatus 100 has entered into the adjustment operating mode, it is possible for the operator to select the normal operating mode by selecting an item for displaying the mode selection screen 430 from menu items of a setting screen, etc.

Figure 9:
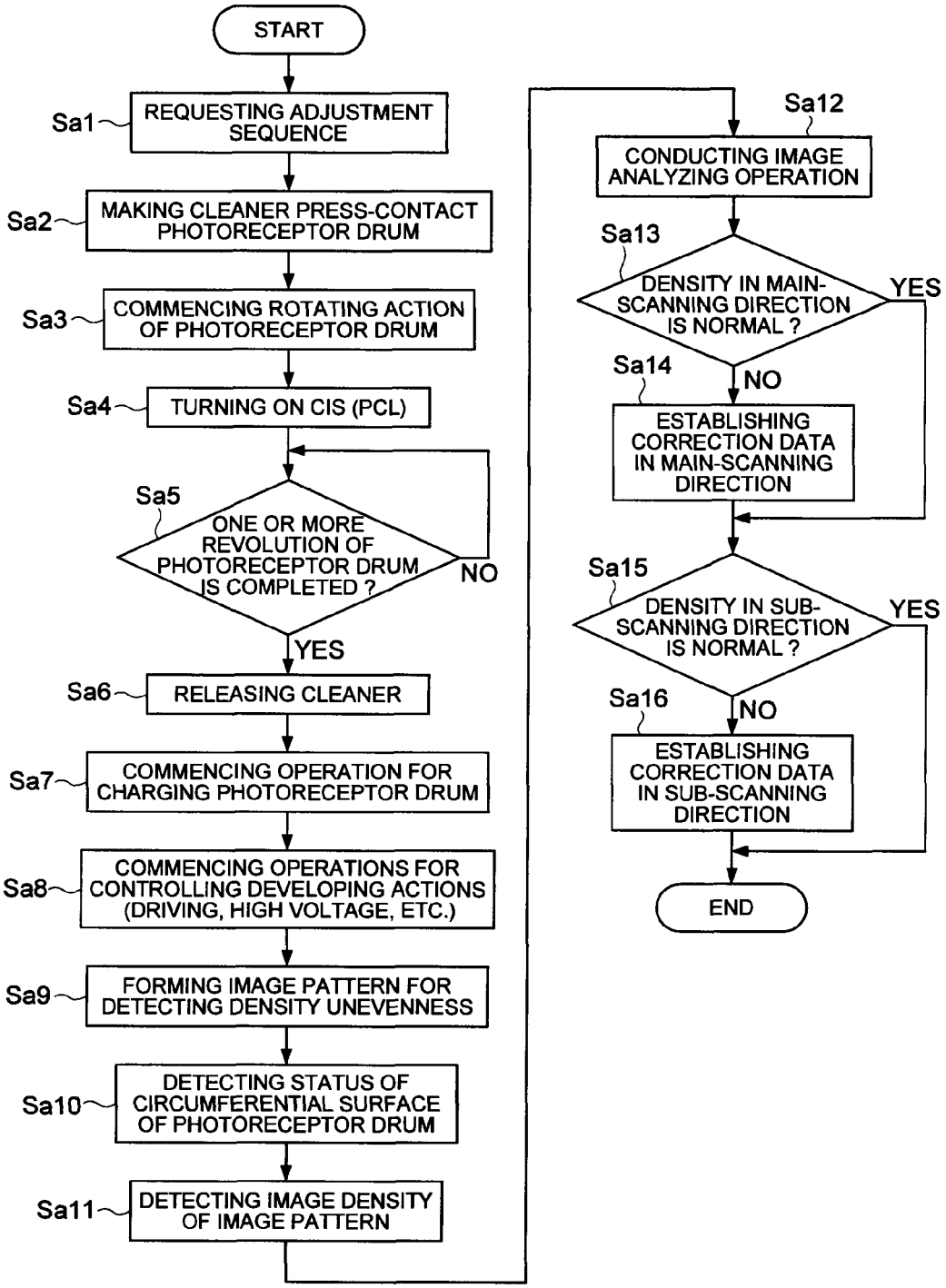
FIG. 9 show a flowchart indicating a processing procedure, to be performed in an adjustment mode, for detecting density unevenness of an image formed on a circumferential surface of a photoreceptor drum, embodied in the present invention.

Next, referring to FIG. 9, the processing procedure to be conducted at the time when the adjustment operating mode is selected will be detailed in the following. The processing procedure concerned is performed under the controlling operations conducted by the control section 10.

Initially, an adjustment sequence is demanded by the selecting operation as abovementioned or by setting the adjusting timing (for instance, a periodical implementation), etc., (Step Sa1). According to the demand concerned, the control section 10 make the cleaning section 6 (cleaner) contact the circumferential surface of the photoreceptor drum 1 with pressure (Step Sa2).

Successively, the control section 10 commences the rotating action of the photoreceptor drum 1 (Step Sa3), and turns ON the LED light source 7 of the CIS unit 83 (Step Sa4). At the time when one or more revolution of the photoreceptor drum 1 has been completed (Step Sa5), the control section 10 release the cleaner (Step Sa6). According to the abovementioned process, it becomes possible to remove residual toner even when the residual toner still remain on the circumferential surface of the photoreceptor drum 1.

After releasing the cleaner, the control section 10 commences the charging operation to be performed by the charging section 2 (Step Sa7), and also commences the operations for driving the developing motors 841 and for controlling the developing process to be performed by the developing high voltage section 852, etc., (Step Sa8).

Associating with the abovementioned operations, the control section 10 forms the image pattern for detecting the density unevenness onto the photoreceptor drum 1 (Step Sa9), and successively, detects the status of the circumferential surface of the photoreceptor drum 1 in the same manner as the processing procedure to be conducted in the normal operating mode (Step Sa10), and then, detects the image density of the image pattern formed on the photoreceptor drum 1 (Step Sa11). After detecting the image density, the control section 10 conducts the image analyzing operation while referring to the relationship between the target density of the concerned image pattern and the actually detected density, so as to determine the degree of the density unevenness (Step Sa12).

Based on the results of determining the degree of the density unevenness, the control section 10 determines whether or not the density in the main-scanning direction is normal (Step Sa13). When determining that the density in the main-scanning direction is normal (Step Sa13; Yes), the control section 10 further determines whether or not the density in the sub-scanning direction is normal (Step Sa15).

When determining that the density in the main-scanning direction is not normal (Step Sa13; No), the control section 10 establishes correction data in the main-scanning direction, corresponding to the density unevenness detected in the abovementioned process (Step Sa14). The correction data concerned is to be employed in the forthcoming next image forming operation, so as to improve the image quality thereof. After establishing the correction data concerned, the control section 10 further determines whether or not the density in the sub-scanning direction is normal (Step Sa15).

When determining that the density in the sub-scanning direction is normal (Step Sa15; Yes), the control section 10 finalizes the consecutive processing concerned (END). When determining that the density in the sub-scanning direction is not normal (Step Sa15; No), the control section 10 establishes correction data in the sub-scanning direction, corresponding to the density unevenness detected in the abovementioned process (Step Sa16). The correction data concerned is to be employed in the forthcoming next image forming operation, so as to improve the image quality thereof. After establishing the correction data concerned, the control section 10 finalizes the consecutive processing concerned (END).

In this connection, after the adjustment operating mode has been completed, it is applicable that the image forming apparatus 100 automatically enters into the normal operating mode, or the operator can select either the normal operating mode or the adjustment operating mode.

In the foregoing, the preferred embodiment of the present invention has been described. However, the scope of the present invention is not limited to the embodiment described in the foregoing. Modifications and additions made by a skilled person without departing from the spirit and scope of the invention shall be included in the scope of the present invention.

As described in the foregoing, according to the present invention, it becomes possible to reduce the frequency of image defect occurrences to a level as lower as possible by detecting abnormalities generated with age on the photoreceptor member and/or in the cleaning section, which are installed in the image forming apparatus concerned, so as to suppress an amount of spoiled paper sheets and material concerned, resulting in a cost reduction for a unit printing operation.

Further, since it also becomes possible to appropriately conduct the operations for changing the photoreceptor member and/or the cleaning section, a frequency of wasted exchanging operations for them can be suppressed and it becomes possible to attain such an effect that the lifetime of the image forming apparatus concerned can be extended.

Still further, with respect to such an image forming apparatus that is provided with an intermediate transfer member and another cleaning mechanism at a secondary transferring section, it becomes easy to specify a defect position when an image defect has been once detected in the image forming apparatus concerned, and accordingly, it becomes possible to attain such an effect that the repairing time can be shortened.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus that comprises:

a photoreceptor member to form a toner image thereon;

a charging section to electrically charge the photoreceptor member;

an exposing section to expose the photoreceptor member charged by the charging section, so as to form a latent image thereon;

a developing section to develop the latent image with toner so as to form the toner image on the photoreceptor member;

a photoreceptor-member transferring section to transfer the toner image formed on the photoreceptor member onto a transfer medium;

a cleaning section to remove residual toner remaining on the photoreceptor member, a light source that is disposed at a position located between the cleaning section and the charging section, to emit an inspection light, which is to be irradiated onto the photoreceptor member over a main-scanning direction thereof;

a tight-contact type image sensor that has a line image sensor to receive the inspection light reflected from a surface of the photoreceptor member; and a control section to determine a status of the surface of the photoreceptor member, based on a result of analyzing the inspection light receive by the line image sensor;

wherein the control section operates in either a normal operating mode or an, adjustment operating mode;

wherein, in the normal operating mode, the control section determine the status of the surface of the photoreceptor member in such a state that the cleaning section press-contacts onto the surface of the photoreceptor member; and wherein, in the adjustment operating mode, the control section deactivates a transferring operation to be performed by the photoreceptor-member transferring section, and makes the cleaning section separate from the surface of the photoreceptor member, and then, controls the light source to irradiate the inspection light onto the surface of the photereceptor member, bearing the toner image thereon, and also controls the line image sensor to receive the inspection light reflected from the surface of the photoreceptor member, so as to detect density unevenness of the toner image based on the result of analyzing the inspection light received by the line image sensor.

2. The image forming apparatus of claim 1, wherein the control section makes judgments in regard to a scar generated on the surface of the photoreceptor member and/or a cleaning defect as an operation for determining the status of the surface of the photoreceptor member.

3. The image forming apparatus of claim 2, wherein the control section makes the judgments in regard to the scar generated on the surface of the photoreceptor member during a period in which an image forming operation is deactivated.

4. The image forming apparatus of claim 2, wherein, when determining the status of the surface of the photoreceptor member, the control section determines an abnormality, which is periodically detected on the photoreceptor member, as the scar generated on the surface of the photoreceptor member.

5. The image forming apparatus of claim 2, wherein, when determining that the scar is generated on the surface of the photoreceptor member as a result of the judgments, the control section implements controlling operations for requesting an operator to change the photoreceptor member to a new one.

6. The image forming apparatus of claim 2, wherein, when determining that the cleaning defect is present on the surface of the photoreceptor member as a result of the judgments, the control section implements controlling operations for requesting an operator to change the cleaning section to a new one.

7. The image forming apparatus of claim 2, wherein, when determining that the cleaning defect is present on the surface of the photoreceptor member as a result of the judgments, the control section implements controlling operations for recovering from the cleaning defect.

8. The image forming apparatus of claim 7, wherein, the controlling operations for recovering from the cleaning defect includes such an operation that temporarily makes the cleaning section apart from the surface of the photoreceptor member.

9. The image forming apparatus of claim 7, wherein the photoreceptor member is shaped in a drum, a rotating action of which is controlled by the control section; and wherein, the controlling operations for recovering from the cleaning defect includes such an operation that temporarily makes a rotating direction of the photoreceptor member reverse to a normal rotating direction thereof.

10. The image forming apparatus of claim 1, wherein the light source also serves as an erasing lamp to eliminate a residual electric potential remaining on the photoreceptor member.

11. The image forming apparatus of claim 1, wherein the control section establishes a correction amount to be employed in an image forming operation, based on the density unevenness detected.

12. The image forming apparatus of claim 1, wherein the control section detects the density unevenness in at least any one of a main-scanning direction and a sub-scanning direction of the photoreceptor member.

* * * * *